US007215351B2

(12) United States Patent
Mindler

(10) Patent No.: US 7,215,351 B2
(45) Date of Patent: May 8, 2007

(54) METHOD AND APPARATUS FOR REDUCING PRINT TIME

(75) Inventor: Robert F. Mindler, Churchville, NY (US)

(73) Assignee: Eastman Kodak Company, Rochester, NY (US)

( * ) Notice: Subject to any disclaimer, the term of this patent is extended or adjusted under 35 U.S.C. 154(b) by 133 days.

(21) Appl. No.: 11/021,249

(22) Filed: Dec. 21, 2004

(65) Prior Publication Data

US 2006/0132580 A1 Jun. 22, 2006

(51) Int. Cl.
*B41J 2/325* (2006.01)

(52) U.S. Cl. ..... 347/176

(58) Field of Classification Search ..... 347/172, 347/174, 176, 216; 400/120.02, 120.03, 400/234

See application file for complete search history.

(56) References Cited

U.S. PATENT DOCUMENTS 4,438,320 A 3/1984 Woodard et al.
4,443,125 A 4/1984 Hirano
4,562,443 A 12/1985 Matsuno et al.
5,636,928 A * 6/1997 Shiina et al. ..... 400/636
5,709,488 A * 1/1998 Imai et al. ..... 400/234
6,400,386 B1 6/2002 No

FOREIGN PATENT DOCUMENTS

JP 06-183045 7/1994

OTHER PUBLICATIONS

Computer-assisted translation of JP 6-183045.*

* cited by examiner

*Primary Examiner*—Huan Tran
(74) *Attorney, Agent, or Firm*—Roland R. Schindler, II

(57) ABSTRACT

A thermal dye transfer printer reduces print time by printing sequential color section from a donor web onto a receiver sheet while the donor web and receiver sheet travel in forward or reverse directions relative to a printer head. A first colored image is formed on the receiver by printing as the donor web and the receiver sheet transit the printer head in a first direction. The donor web is indexed to bring the trailing edge of a second color section in registration with the trailing edge of the first colored printed image on the receiver web portion. Then the image receiver web transits the printer head in the opposite direction and the second color is printed on the receiver sheet in combination with the receiver sheet. The steps are repeated for all color patches.

19 Claims, 3 Drawing Sheets

METHOD AND APPARATUS FOR REDUCING PRINT TIME

FIELD OF THE INVENTION

This invention relates to printers and, in particular, to multicolor dye transfer printers.

BACKGROUND OF THE INVENTION

Digital photography is highly competitive with conventional photography. One disadvantage of digital photography is the quality and durability of prints of images taken with a digital camera. While computer screens display vivid images, photographers still want hard copies of their pictures. Conventional prints from photofinishers are far superior to most prints made from home based printers because many home based printers use ink jet technology. Ink jet printers are low cost devices and they provide a range of prints, some of which are unacceptable, others that fade quickly, and some that have good color and long life. One of the better printers for color digital photography images is the thermal dye transfer printer. It creates an image from sequential patches of different colors and applies a clear, protective coating to the finished print. These printers reproduce excellent images that are quite durable and generally superior to images made with ink jet printers.

However, thermal dye transfer printers are inherently slow. Ink jet printers simultaneously deposit different color inks to make an image. In contrast, thermal dye transfer printers deposit only one color at a time. Their speed is further reduced by the conventional process of returning the printed paper to its initial position before a second color is printed on the paper. In order to print three colors and a clear coat on a paper, a printer shuffles the paper back and forth seven times: one time for each color or layer and one time to reload for the three subsequent colors or layers. There is a need to make thermal dye transfer printers quicker and to reduce the time it takes to make a color print using a thermal dye transfer printer.

Thermal dye transfer printers are also popular in printing kiosks. The Eastman Kodak Company markets and sells a line of printing kiosks that provide users with thermal dye transfer prints of digital photographs. The kiosks are user friendly and have touch screens with menu driven programs for showing a digital camera user how to make prints of digital images.

Nevertheless, printing thermal dye transfer images is inherently slow. A state of the art 4"×6" thermal dye transfer printer takes between 11 and 12 seconds to make a print. In order to give consumers a net printing time of about five or six seconds, kiosks are equipped with two 4"×6" printers. The printing operation alternates between the two printers so that the average time per print is about five or six seconds.

That solution imposes a high cost of capital equipment on each kiosk. There is still an unsolved problem of economically reducing the net print time. Studies show that about half of the 11 to 12 second print time is spent in handling receiver paper and dye transfer rolls. Hence, even if the actual time of image transfer was zero, the handling time for the receiver and donor webs would be at the current net time experienced by consumers. A zero image print time is impossible, but even a 50% improvement would still leave the consumer with an average print time of about eight seconds. Therefore, even a 50% reduction in image print time, by itself, will not materially reduce the time experienced by consumers or allow the kiosk to print with only one 4"×6" printer.

SUMMARY OF THE INVENTION

The invention provides both an apparatus and a process for rapidly printing images with two or more colors. The invention is particularly useful with thermal dye transfer printers that include sequential sections of colored or clear donor material. In a conventional web, the donor material includes sequential sets of sections of yellow, magenta, cyan and clear. The clear section has a transparent protective layer that also transfers via heat. The individual colored or clear sections are printed one at a time onto the receiver sheet. With the invention, a section of a color donor web is registered opposite a receiver sheet prior to transfer of the donor material to the receiver sheet. A printer head moves relative to a platen to engage and disengage the donor web. The printer head urges the donor web against the receiver sheet that is supported on a platen. A controller energizes the printer head and drives the donor web and receiver sheet in order to transfer the donor material to the receiver sheet. After transferring one color, the apparatus stops and disengages the print head from the donor material. The donor material indexes to the next section of a different or transparent color and registers the next section with the printer head and the image receiver. The printer head re-engages the donor web and presses the web against the receiver sheet that is supported on the platen. The donor web and receiver sheet are then driven in a direction opposite to the first printing operation in order to deposit the second color or transparent layer. The above steps are repeated as many times as there are sequential sections of donor material in order to complete the printing operation.

One of the features of this invention is that the apparatus and method print in two directions. As such, the invention reduces the number of times a given receiver sheet transits the print path in the apparatus. In conventional printing apparatus, the receiver sheet transits in the forward and reverse direction to print each color. In other words, the printer sheet advances past the print head, stops and returns to its initial position before the next color prints onto the receiver sheet. In contrast, the invention prints on the receiver sheet in both directions. In a conventional thermal dye transfer printer, a receiver sheet transits the printer head at least seven times: four times in one direction for printing and three times in the opposite direction for reloading prior to printing. However, with the invention, the receiver sheet transits the printer head only four or at most five times. Thus, the invention provides more rapid printing and fewer steps.

DETAILED DESCRIPTION OF THE INVENTION

Figure 1:
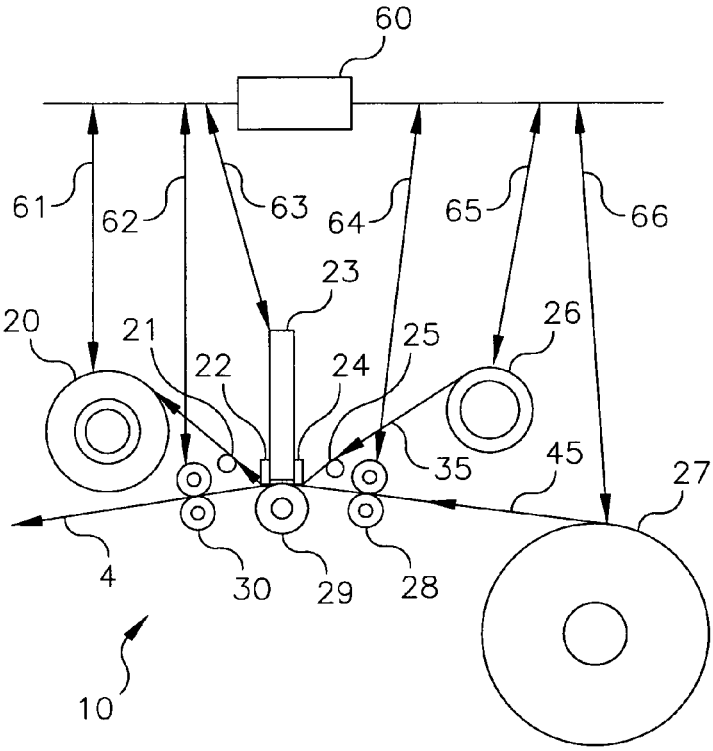
FIG. 1 is a schematic of an apparatus showing printing in the forward (first) direction.
Figure 2:
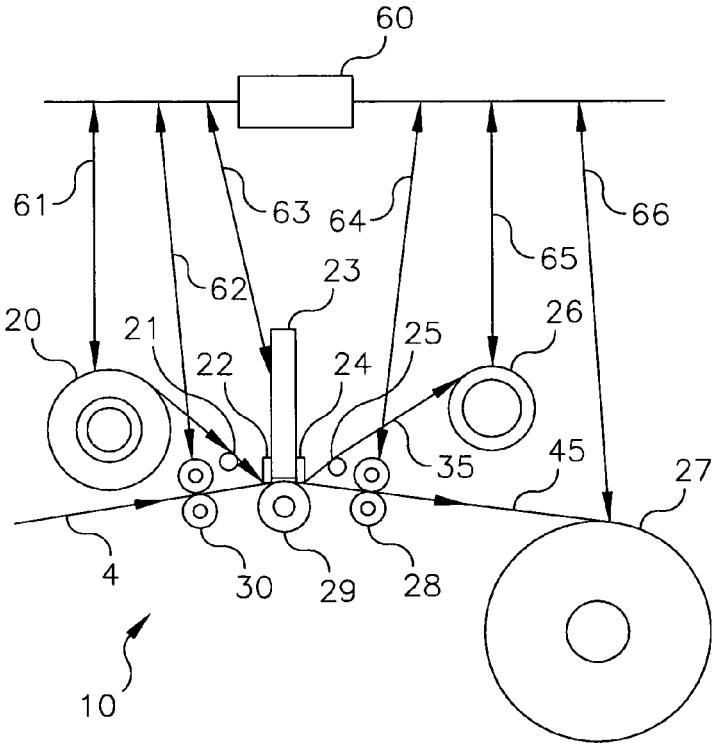
FIG. 2 is a schematic of an apparatus showing printing in the reverse (opposite) direction.

Turning to FIG. 1, there is shown a schematic of a thermal printer 10 for performing the alternating printing of the invention. The printer 10 has a donor web supply spool 26 that supports a donor web 35 of thermal transfer donor material. The donor web 35 extends along a path that includes the donor web supply spool 26, a first idler roller 21, a first stripping plate 22, thermal print head 23, a second stripping plate 24, a second idler roller 25 and donor web take-up spool 20. Image receiver web 45 travels back and forth along a path 4. The arrows of path 4 show the forward direction in FIG. 1; the arrows of path 4 in FIG. 2 show the reverse direction. Image receiver web 45 may be any suitable material, cloth or paper including but not limited to special paper for receiving thermal dye transfer images of digital photographs. The image receiver web 45 travels back and forth along path 4 that includes a pair of forward drive rollers 30, a freely rotating support platen roller 29, and a pair of reverse drive rollers 28. When the print head 23 engages the donor web 35 and receiver web 45, friction between the two webs is strong enough for the drive rollers 30 and 28 to move the two webs together past the print head 23. The driver rollers have relatively powerful motors or gear trains that provide high enough torque to move the webs 35 and 45. In contrast, torque applied to the supply spool 26 and take-up spool 20 is just enough to prevent slack in the donor web 35. In operation, forward drive rollers 30 pull the donor web 35 and receiver web 45 from right to left and driver rollers 28 pull the webs 35 and 45 in the opposite direction. The donor web 35 passes over and contacts the print head 23. The image receiver web 45 is disposed between the donor web 35 and a free turning platen roller 29. Spools 20, 26 and 27 have suitable drive motors (not shown) and/or drive trains for turning the spools in clockwise or counterclockwise directions to accommodate driving the webs 35 and 45 in forward and reverse directions.

The printer 10 has suitable circuits, sensors, integrated circuits, processors, memory, operating and application software, for operating and controlling the printer 10 and the individual components thereof. In particular, the controller 60 raises and lowers the print head 23, selectively operates the heater elements in the print head 23 that transfer donor material from the donor web 35 to the receiver web 45, operates the drive rollers 28, 30 to move the receiver web 45 in the forward (right to left) and reverse (left to right) directions, operates the supply spool 26 and take-up spool 20 to move the donor web 35 in forward or reverse directions. Controller 60 has leads 61 and 65 that that connect the controller 60 with sensors and actuators at the supply spool 26 and take-up spool 20. Other leads 62, 64 connect the controller 60 to the drive rollers 30, 28. Lead 63 connects the controller 60 to the print head and carries signals for actuators that raise and lower the print head and also selectively operate the heating elements in the print head. Another lead 66 connects the controller 60 to receiver web spool 27.

Those skilled in the art understand that the schematic of FIG. 1 omits details of the controls for operating the printer 10. However, these controls are generally conventional and may be found in other machines and are otherwise well-known to those skilled in the art. Likewise, this description omits the motors, solenoids and other actuators, sensors and encoders that are used for turning and driving the supply spool 26 and take-up spools 20 and the drive rollers 30 and 28 and receiver web spool 27. Again, those items are well-known to those skilled in the art. Likewise known to those skilled in the art know of suitable electronics for actuating the heat elements in a linear array of a thermal print head. Those skilled in the art also understand that the thermal print head 23 and the platen roller 29 are kept in close engagement during printing. A linear actuator moves the print head 23 relative to the platen roller 29 in order to permit the donor web 35 to index from one color section to another.

Figure 3:
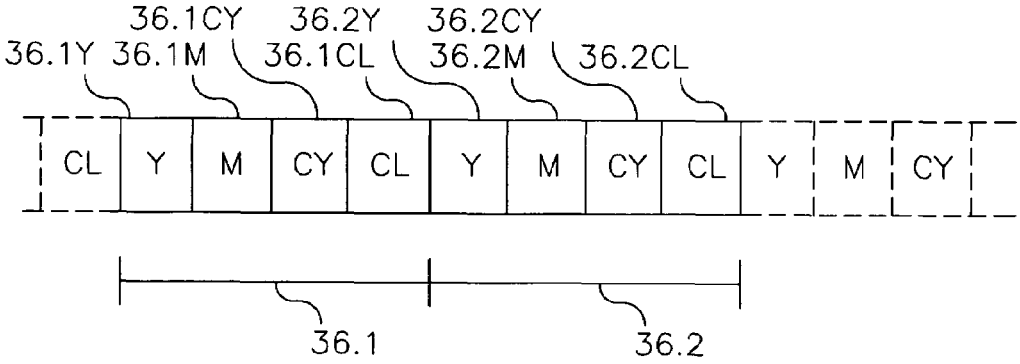
FIG. 3 is a plan view of a portion of a web showing two complete sets of color sections.
Figures 4A, 4B, 4C:
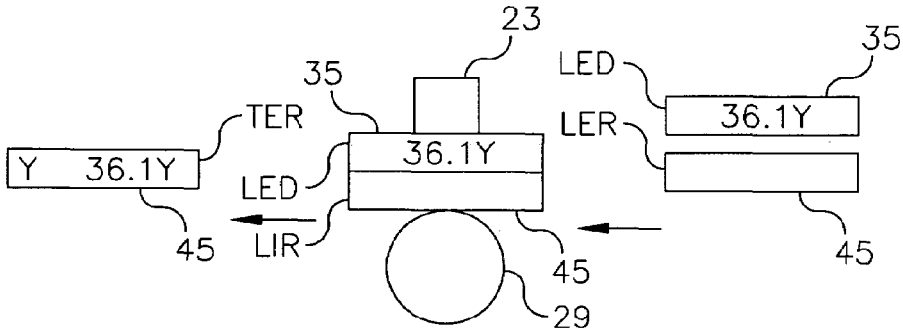
FIGS. 4A–4L illustrate the reciprocating operation of the receiver sheet.
Figures 4D, 4E, 4F:
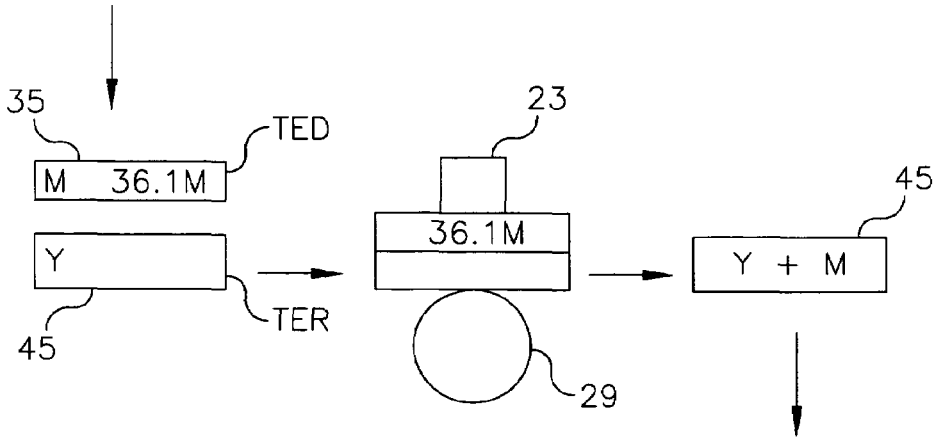
Figures 4G, 4H, 4I:
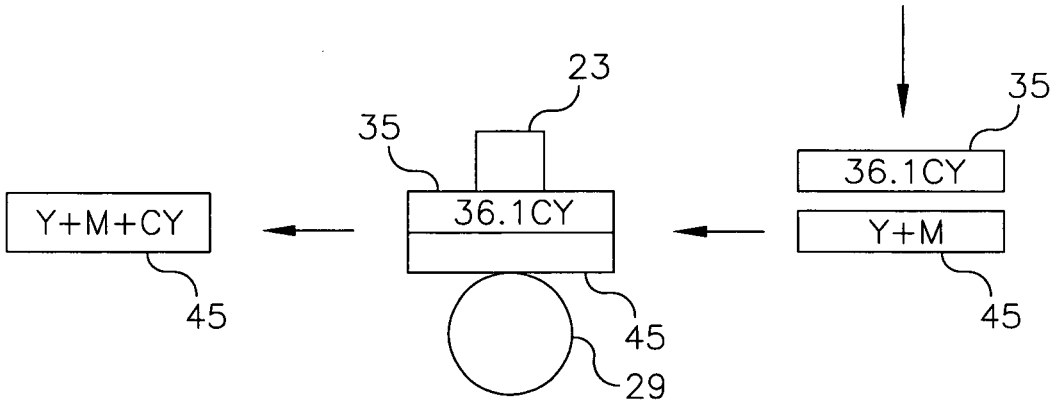
Figures 4J, 4K, 4L:
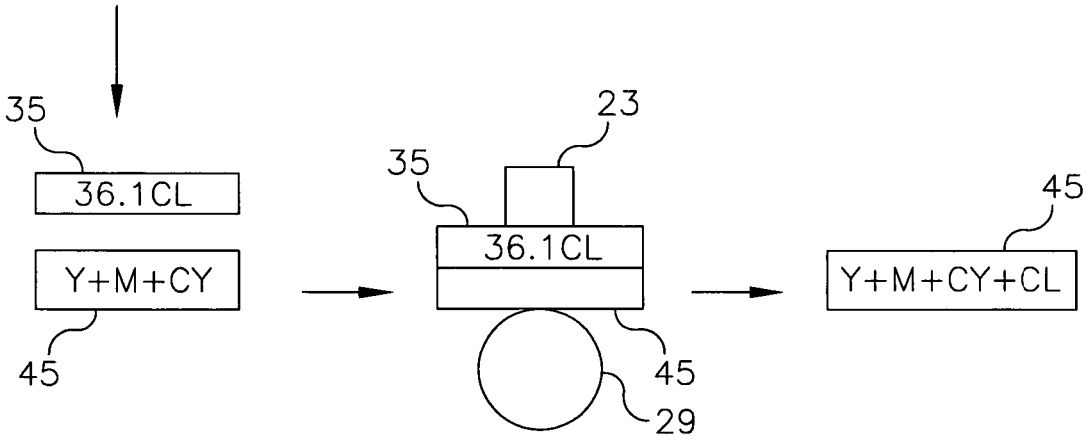

With reference to FIG. 3, a typical donor web 35 portion shows two sets of a number of sequential sets of color and clear sections. The first set 36.1 of sequential sections includes a yellow, magenta, cyan and clear sections identified, respectively, by reference numerals 36.1Y, 36.1M, 36.1CY and 36.1CL. A second set 36.2 of sequential sections follows the first set and so on. Each section has a leading edge (L) and a trailing edge (T). In order to provide a full color image with a clear protective coating, the four sections of each set 36.1, 36.2, etc. are printed, in registration with each other, onto the same portion of the image receiver web 45. For purposes of explanation, the leading edge is always on the left hand side and the trailing edge is always on the right hand side regardless of the direction of travel of the donor web 35.

The first color is printed in the conventional direction, from right to left as seen by the viewer. See FIGS. 1 and 3. Controller 60 raises the print head and actuates the driver rollers 30 to register a portion of the receiver web 45 on the platen roller 29 beneath the print head 23. Controller 60 actuates supply spool 26 and take-up spool 20 to advance a leading edge of a first (yellow) section 36.1Y of donor web 35 to the print head 23 for registration with the receiver web 45 and for printing a first (yellow) donor color on the receiver web 45. Thus, in the example shown in FIG. 3 and FIGS. 4A–4C, the first (yellow) section 36.1Y is advanced to the print head 23. There the lower surface of donor web 35 engages the receiver web 45 which is supported by the platen roller 29. The leading edge LED of the first (yellow) section 36.1Y is registered at printer head 23 with a leading edge LER of an image receiving area on the image receiver web 45. Controller 60 lowers the print head 23 to engage the donor web 35 with the receiver web 45. Controller 60 actuates drive rollers 30 and supply spool 26 and take up spool 20 to move the webs 35 and 45 together past the print head 23. Controller 60 selectively operates heater elements in the print head 23 to transfer donor material from donor web 35 to receiver web 45. As the webs 35 and 45 leave the print head 23, stripping plate 22 separates the donor web 35 from the receiver web 45. The donor web 35 continues over idler roller 21 toward the donor take-up spool 20 and the partially printed portion of receiver web 45 is supported on a guide (not shown). The trailing edge TER of the printed portion of the receiver web 45 remains on the platen roller 29.

The next color is printed in the reverse direction, i.e., from left to right. See FIGS. 2 and 3. To do so, a second (magenta) section 36.1M of donor web 35 is advanced from spool 26 to the print head 23. Controller 60 operates the supply spool 26 and take-up spool 20 to drive the second (magenta) section 36.1M so that its trailing edge TED is registered at the trailing edge TER of the printed portion of the receiver web 45 on the platen roller 29. Controller 60 lowers the print head 23 to press the donor web 35 against the receiver web 45 that is supported on the platen roller 29. Controller 60 operates the drive rollers 28, the receiver web spool 27 and the donor supply spool 26 and take-up spool 20 to move the donor web 35 and receiver web 45 together beneath the print head 23. See FIGS. 2 and 4D–4F. Controller 60 selectively operates heater elements in the print head 23 to transfer the second color (magenta) from the donor web 35 onto the receiver web 45. The stripping plate 24 separates the webs 35 and 45 from each other and the donor web travels over idler roller 25 for temporary storage on supply spool 26.

The above operations are repeated to transfer the third (cyan) and fourth (clear) sections 36.1CY, 36.1CL to the receiver web. Those operations are shown in FIGS. 4I–4L. However, as a preliminary step the expended portion 36.1 M of the second section is advanced past the print head 23 and onto the take-up spool 20 so that the third (cyan) section 36.1CY may be advanced to and registered with the receiver web at the print head 23. Once so positioned, the operations described above are repeated to print the third (cyan) and fourth (clear) section onto the receiver web 45. In a final operation, the printed portion of the image receiver web 45 is cut from the rest of the web 45 and discharged as a finished print of the digital image. Those skilled in the art understand that the above process could begin by predisposing the trailing edge of the yellow portion opposite the trailing edge of the image receiver sheet and performing the first print in the reverse direction.

The apparatus and method described above provide an average printing time for a single print of between five or six seconds. As such, the invention may save capital equipment expenses in photo kiosks by allowing the manufacturer to use only one 4"×6" printer for each machine rather than the two printers that are currently used. As an alternative, kiosks could be equipped with two of the printers using the invention and the net printing time for a set of prints could be further reduced to between two to three seconds by using both machines to alternately make prints. It will be appreciated that one of the printing times and printing rates described in this paragraph are exemplary only and that the invention can be practiced to increase the rate at which any printer of this type can generate images without inherently requiring an increase in printing speed.

The invention may be incorporated into existing printer designs by certain modification. The invention requires stripping plates blades on both sides of the printer head; prior art printers need only one stripping plate. Where the prior art printers use one set of drive rollers and drives the image receiver web 45 and donor web 35 in only one (forward) direction, the invention has a pair of such drive rollers on each side of the printer head 23 to drive the pinched image receiver web 45 and donor web 35 through the printer head in opposite directions. Suitable controls and shaft encoders are used on the donor web 35, supply spool 26, take up spool 20, and the drive rollers 28 and 30 accurately register the donor web 35 and the image receiver web 45. After printing is complete, the printed portion of the image receiver web 45 is cut from the receiver web 45 with a cutter (not shown) to provide a print of the digital image.

The invention has been described in detail with particular reference to certain preferred embodiments thereof, but it will be understood that variations and modifications can be effected within the spirit and scope of the invention.

PARTS LIST

10 printer
20 donor web take-up spool
21 idler roller
22 first stripping plate
23 thermal print head
24 second stripping plate
25 second idler roller
26 donor web supply spool
27 receiver web spool
28 reverse drive rollers
29 support platen roller
30 forward drive rollers
35 donor web
36.1 first set of sequential sections
36.1Y Yellow sequential section
36.1M Magenta sequential section
36.1CY Cyan sequential section
36.1CL Clear sequential section
36.2 second set of sequential sections
45 image receiver web
60 controller
61, 65 leads to 20, 26
62, 64 leads to 30, 28
63 lead to print head 23
66 lead to receiver web spool 27
LED leading edge of donor
LER leading edge of receiver
TED trailing edge of donor
TER trailing edge of receiver

The invention claimed is:

1. An apparatus for printing multicolor prints composing:

a color donor web of two or more sequential sections of donor material of transparent or colored donor material, said donor web operable to dispose its sequential sections opposite a receiver sheet prior to transfer of the donor material to the receiver sheet;

a printer head for engaging and disengaging the donor web to press the donor web against the receiver sheet;

a platen opposite the printer head for supporting the donor web and receiver sheet, and for carrying the donor web and receiver sheet past the printer head in forward and reverse directions; and a controller for energizing the printer head during said forward and reverse travel of donor web and receiver sheet to transfer donor material from a first sequential section during the forward travel and to transfer donor material from the next sequential section during reverse travel, further comprising first and second pairs of pinch rollers, each pair including a driven roller and a idler roller and having at least one roller of each pair operable to move toward and away from the receiver sheet for selectively pinching the receiver sheet so that the driven roller of the pinched pair can move the pinched receiver sheet past the printer head.

2. The apparatus of claim 1, wherein one pair of pinch rollers moves the receiver sheet in one direction and the other pair of pinch roller moves the receiver sheet in the opposite direction.

3. The apparatus of claim 1, having first and second release blades on opposite sides of the printer head for releasing the donor web from the receiver sheet as the donor web and receiver sheet travel past the printer head in either direction.

4. The apparatus of claim 1, further comprising a donor roller indexing motor for indexing the donor web to dispose sequential sections opposite the receiver sheet during forward and reverse travel of the donor web and receiver sheet past the printer head.

5. The apparatus of claim 4, wherein the donor roller indexing motor is connected to the controller and the controller operates the donor roller indexing motor.

6. The apparatus of claim 1, further comprising a platen drive motor connected to the platen for moving the platen in opposite directions.

7. The apparatus of claim 6, having first and second stripper plates on opposite sides of the printer head for releasing the donor web from the receiver sheet as the receiver sheet travels past the printer head in either direction.

8. The apparatus of claim 6, wherein the platen is cylindrical and the motor turns the platen clockwise and counterclockwise.

9. The apparatus of claim 1, wherein the platen drive motor is connected to the controller and the controller operates the platen drive motor.

10. The apparatus of claim 1, further comprising a printer head motor for moving the printer head into and out of engagement with the donor web for pressing and releasing the donor web against the receiver sheet and the platen, respectively.

11. The apparatus of claim 10, wherein the printer head motor is connected to the controller and the controller operates the printer head motor.

12. A printing apparatus for printing multicolor prints comprising:

a color donor web with two or more sequential sections of donor material of transparent or colored donor material;

a moveable printing means for engaging and disengaging the donor web and pressing the donor web against a receiver sheet;

a support means for carrying and supporting the donor web and the receiver sheet past the printing means during transfer of donor material from the donor web to the receiver sheet; and a control means for controlling the movable printing means and the support means to execute at least one printing cycle, said printing cycle comprising:

disposing a first sequential section of the donor web to be opposite the receiver sheet on the support means;

moving the printer head toward the donor web for engaging the donor web and pressing the donor web against the receiver sheet on the support means;

pinching the receiver sheet between a first pair of pinch rollers comprising a driver roller and an idler roller with at least one roller of each pair operable to move toward and away from the receiver sheet for pinching the receiver sheet, and with the drive roller of the first pair of pinch rollers being operable for moving the pinched receiver sheet past the printhead to a point where it can be pinched by a second of the pair of pinch rollers in one direction past the printing means;

transferring donor material from the first donor web section to the receiver sheet during its transit past the printing means;

moving the printing means away from the donor for disengaging the donor web from the printing means;

releasing the donor web from against the receiver sheet on the support means;

advancing the donor web to the next sequential donor web section of donor material;

moving the printing means toward the donor web for engaging the donor web and pressing the donor web against the receiver sheet on the support means;

pinching the receiver sheet between a driver roller and an idler roller composing the second pair of pinch rollers;

moving the receiver sheet by rotating the drive roller of the second pair to move the receiver sheet in a reverse direction and moving the donor web in a reverse direction past the printing means; and transferring donor material from the next sequential donor web section to the receiver sheet during its transit past the printing means.

13. The method of claim 12, further comprising a web gripping and moving means for gripping and moving the donor web relative to the printing means in the forward and reverse directions.

14. The method of claim 12, further comprising the further steps of repeating the printing cycle until each of the sequential sections of the donor web are printed onto the receiver sheet.

15. A method for printing multicolor prints with a printer having a color donor web with two or more sequential sections of donor material of transparent or colored donor material, a moveable printer head for engaging and disengaging the donor web and pressing the donor web against a receiver sheet, a platen for carrying and supporting the donor web and the receiver sheet past the printer head during transfer of donor material from the donor web to the receiver sheet, a first pair of pinch rollers positioned on one side of the platen and adapted to selectively pinch the receiver medium and to move the receiver medium past the platen to a second pair of pinch rollers positioned on an opposite side of the platen and adapted to selectively pinch the receiver medium and to move the receiver medium past the platen, the method comprising the steps of:

positioning a receiver medium where it can be pinched between the first pair of pinch rollers;

pinching the receiver medium between the first pair of pinch rollers;

disposing a first sequential section of the donor web opposite the receiver sheet on the platen;

moving the printer head toward the donor web for engaging the donor web and pressing the donor web against the receiver sheet on the platen;

moving the receiver sheet and donor web in a forward direction past the printer head;

transferring donor material from the first donor web section to the receiver sheet during its transit past the printer head;

moving the printer head away from the donor for disengaging the donor web from the printer head;

releasing the receiver medium from the first pair of pinch rollers and pinching the receiver medium using the second pair of pinch rollers;

releasing the donor web from against the receiver sheet on the platen;

advancing the donor web to the next sequential donor web section of donor material;

moving the printer head toward the donor web for engaging the donor web and pressing the donor web against the receiver sheet on the platen;

moving the receiver sheet and donor web in a reverse direction past the printer head; and transferring donor material from the next sequential donor web section to the receiver sheet during its transit past the printer head, wherein movement of the receiver medium is caused by rotating the pair of pinch rollers pinching the receiver medium.

16. The method of claim 15, comprising the further steps of repeating the steps of claim 15 until each of the sequential sections of the donor web are printed onto the receiver sheet.

17. The method of claim 15, wherein the donor web comprises a plurality of sequential sections comprising patches of yellow, magenta, cyan and a clear protective donor material, each section having leading and trailing edges.

18. The method of claim 17, wherein the leading edge of the yellow section is first printed onto a leading edge of a receiver sheet and the trailing edge of the magenta section is first printed onto the trailing edge of the yellow printed receiver sheet.

19. The method of claim 15, wherein the trailing edge of the yellow section is first printed onto a trailing edge of a receiver sheet and the leading edge of the magenta section is first printed onto the leading edge of the yellow printed receiver sheet.

* * * * *